US009145732B2

(12) United States Patent
Frigerio

(10) Patent No.: US 9,145,732 B2
(45) Date of Patent: Sep. 29, 2015

(54) SWINGING BLADE COVERING STRUCTURE

(71) Applicant: FRIGERIO TENDE DA SOLE S.R.L., Capurso (BA) (IT)

(72) Inventor: Alessandro Frigerio, Capurso (IT)

( * ) Notice: Subject to any disclaimer, the term of this patent is extended or adjusted under 35 U.S.C. 154(b) by 12 days.

(21) Appl. No.: 14/077,092

(22) Filed: Nov. 11, 2013

(65) Prior Publication Data

US 2014/0130988 A1 May 15, 2014

(30) Foreign Application Priority Data

Nov. 9, 2012 (IT) ..... MI2012A1911

(51) Int. Cl.
*E04F 10/10* (2006.01)
*E06B 9/262* (2006.01)
*E04B 7/16* (2006.01)

(52) U.S. Cl.
CPC ..... *E06B 9/262* (2013.01); *E04B 7/163* (2013.01); *E04B 7/166* (2013.01); *E04F 10/10* (2013.01)

(58) Field of Classification Search
USPC ..... 160/61, 62, 133, 172 R
IPC ..... E04F 10/10; E06B 9/0638,9/0661, E06B 9/34; E04B 7/166, 7/163
See application file for complete search history.

(56) References Cited

U.S. PATENT DOCUMENTS

| | | | | | |
|---|---|---|---|---|---|
| 2,572,944 | A | * | 10/1951 | Mullin | 160/62 |
| 2,591,758 | A | * | 4/1952 | Zack | 160/62 |
| 2,957,520 | A | * | 10/1960 | Howard | 160/113 |
| 3,578,060 | A | * | 5/1971 | Spencer | 160/172 R |
| 3,651,852 | A | * | 3/1972 | Neri | 160/172 R |
| 3,853,169 | A | * | 12/1974 | Music et al. | 160/172 R |
| 4,324,284 | A | * | 4/1982 | Frei | 160/172 R |
| 5,566,738 | A | * | 10/1996 | Yadidya | 160/133 |
| 5,584,331 | A | * | 12/1996 | Lin | 160/172 R |

* cited by examiner

*Primary Examiner* — David Purol
(74) *Attorney, Agent, or Firm* — John C. Laurence; David D. Rodrigues

(57) ABSTRACT

A composite covering structure for providing protection against sun and rain comprises a plurality of adjoining and overlapping swinging blades, coupled to a driving mechanism adapted, by a single operation, at first to cause the blades to gradually turn about their longitudinal axis, while being held in a same position, for providing a partial protection against sun, and then to cause said blades to slide on a horizontal plane, so as to compact said blades on a side, for uncovering the previously covered area.

7 Claims, 15 Drawing Sheets

SWINGING BLADE COVERING STRUCTURE

BACKGROUND OF THE INVENTION

The present invention relates to a swinging blade covering structure.

Covering structures, so-called "sun breaking structures", including a plurality of swinging blades are already known.

A prior structure comprises a plurality of "S" cross-section aluminium blades, arranged with an adjoining relationship with respect to one another and adapted to overlap onto one another.

The above structure comprises moreover a gutter channel, downstream of each blade, which channel conveys its water to further side channels.

Each swinging blade of the above prior structure turns, together with the others, about pivot pins arranged on a pivot pin longitudinal axis at the end portions of the structure.

This movement is transmitted to the side gutters, in turn coupled to the swinging blades by means of a series of coupling pins arranged on their axis, or by other coupling systems including corresponding support elements for engaging and support individual blades swinging by an arm element swinging system.

Another prior sun breaking arrangement is based on the pantograph system in which the swinging blades are directly coupled to one of the two parallel diagonal lever series of the pantograph arrangement.

This system, which is able of operating both horizontally and vertically, as a roof or wall arrangement, has however the drawback that it does not allow the swinging blades to swing about their longitudinal axis, without a full closure of the pantograph arrangement.

In other words, as the pantograph arrangement is in a released condition, all the swinging blades will assume a horizontal position, and only when the pantograph arrangement is in a fully "closed" condition the swinging blades will have a nearly vertical position.

This does not allow a user to properly choose the swinging blade orientation, without fully opening the roofing or shed construction.

In other words, the pantograph arrangement substantially operates as a gate covering arrangement, and not as a substantially withdrawable sun breaking system.

SUMMARY OF THE INVENTION

Accordingly, the aim of the present invention is to provide a swinging blade covering structure which is improved in comparison with prior sun breaking covering systems.

Within the scope of the above mentioned aim, a main object of the invention is to provide such a covering structure, comprising a plurality of adjoining and overlapping swinging blades, for providing a rain and sun protection, and being coupled to a driving mechanism able, by a single operation, to cause said swinging blades at first to gradually turn about a longitudinal axis thereof, while remaining in a same position, for providing a partial protection against sun, and then to slide in a horizontal plane, by overlapping them on a side, to uncover the previously covered area.

Another object of the present invention is to provide such a swinging blade covering structure providing a smooth and accurate response to their driving systems.

Another object of the present invention is to provide such a swinging blade covering structure which, owing to its specifically constructional features, is very reliable and safe in operation.

According to one aspect of the present invention, the above mentioned aim and objects, as well as yet other objects which will become more apparent hereinafter, are achieved by a swinging blade covering structure, characterized in that said structure comprises a plurality of blades, arranged in parallel with one another and each being adapted to turn about its longitudinal axis, said blades having blade end portions coupled to an extensible link system so designed as to allow said blades to be controllably turned and translated, said system performing, by a single operation, a first gradual rotation of the links about their longitudinal axis while remaining in a same position for providing a partial protection against sun, and then a translation of said links on a plane, thereby laterally compacting said links to uncover a covered area of said structure.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative but not limitative example, in the accompanying drawings, where.

DESCRIPTION OF THE PREFERRED EMBODIMENTS

Figure 1:
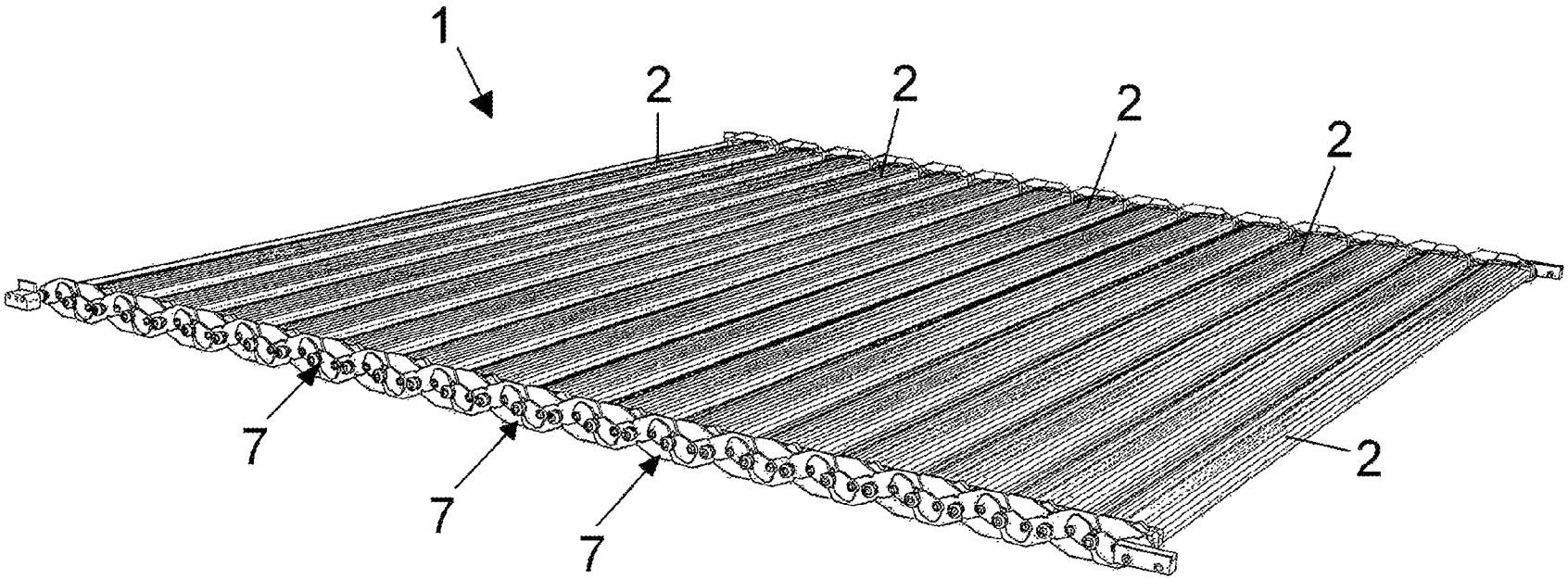
FIG. 1 is a perspective view of the swinging blade covering structure according to the present invention.
Figure 2:
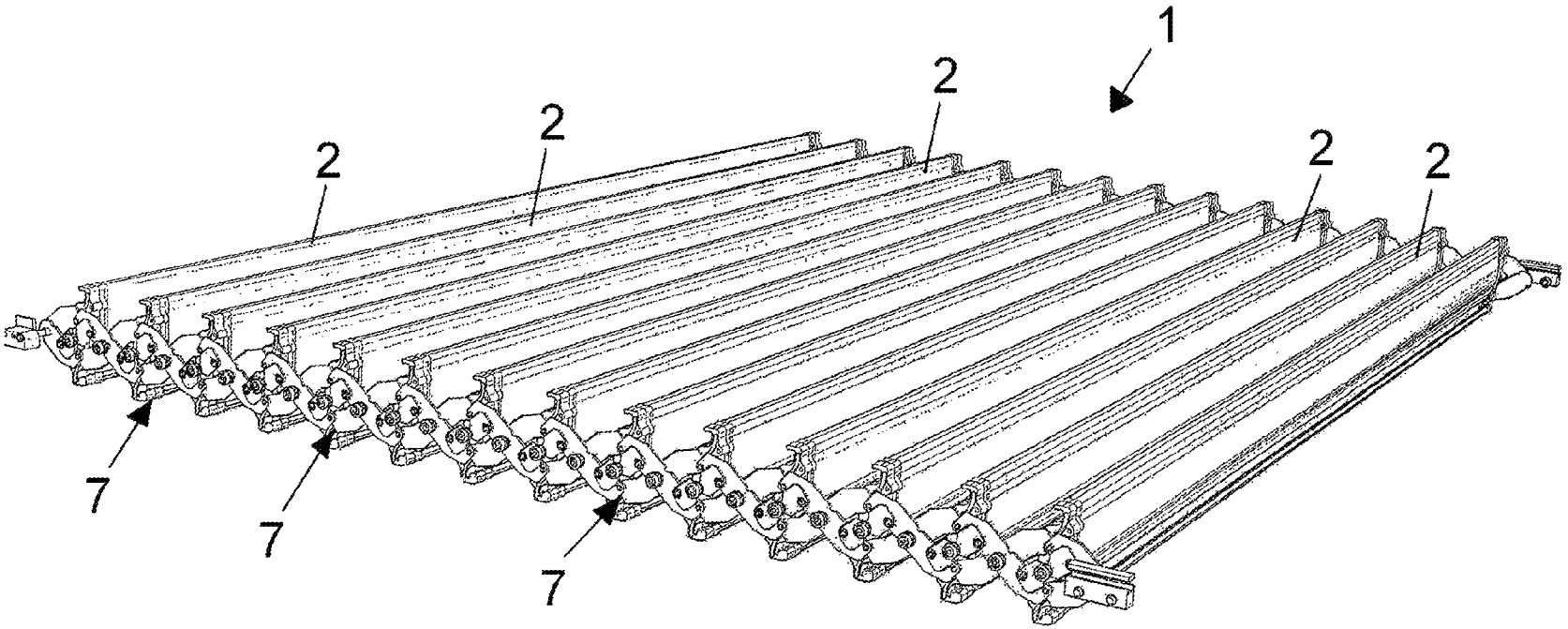
FIG. 2 is a further perspective view, on a larger scale than that of FIG. 1, of the inventive structure, being shown with the swinging blades at an open position, turned through 90°.
Figure 3:
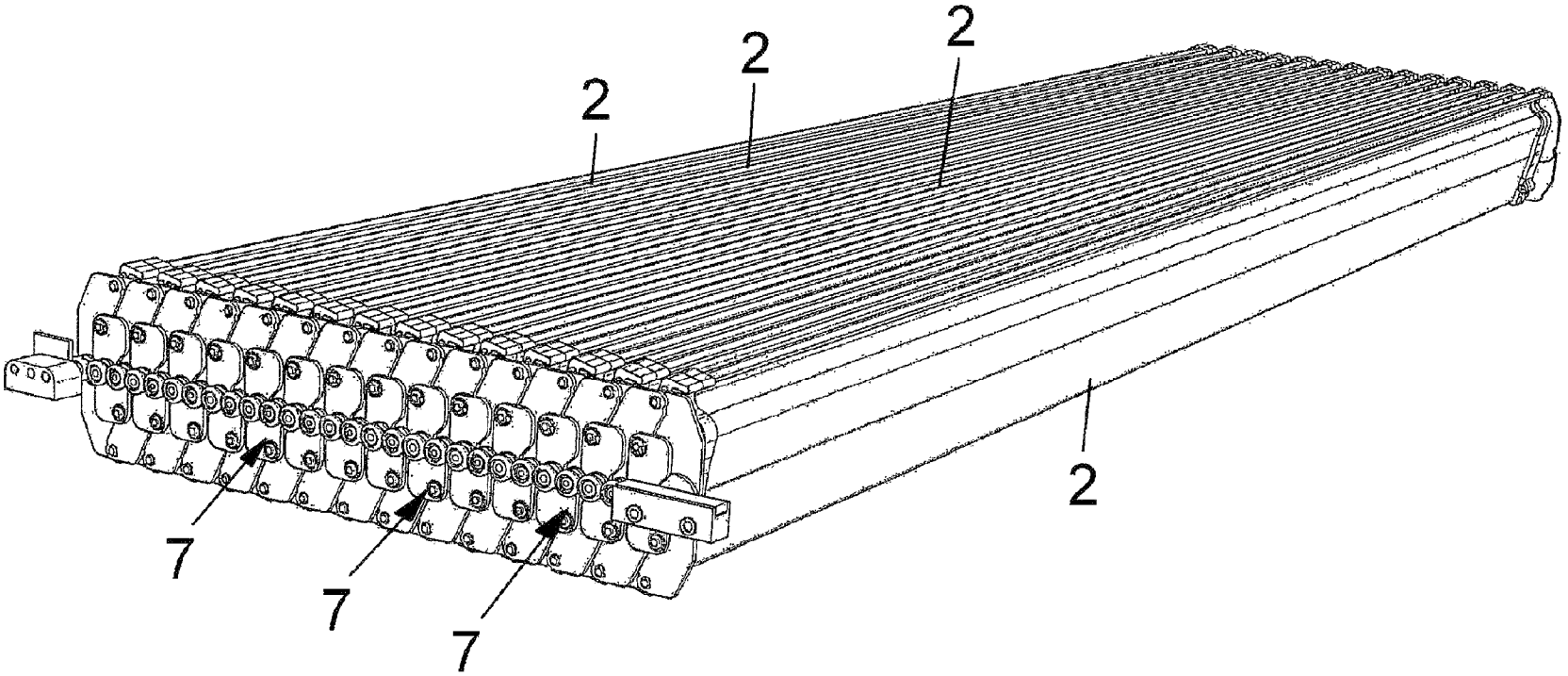
FIG. 3 is yet another perspective view of the swinging blades shown in a "compacted" or closed condition thereof.
Figure 4:
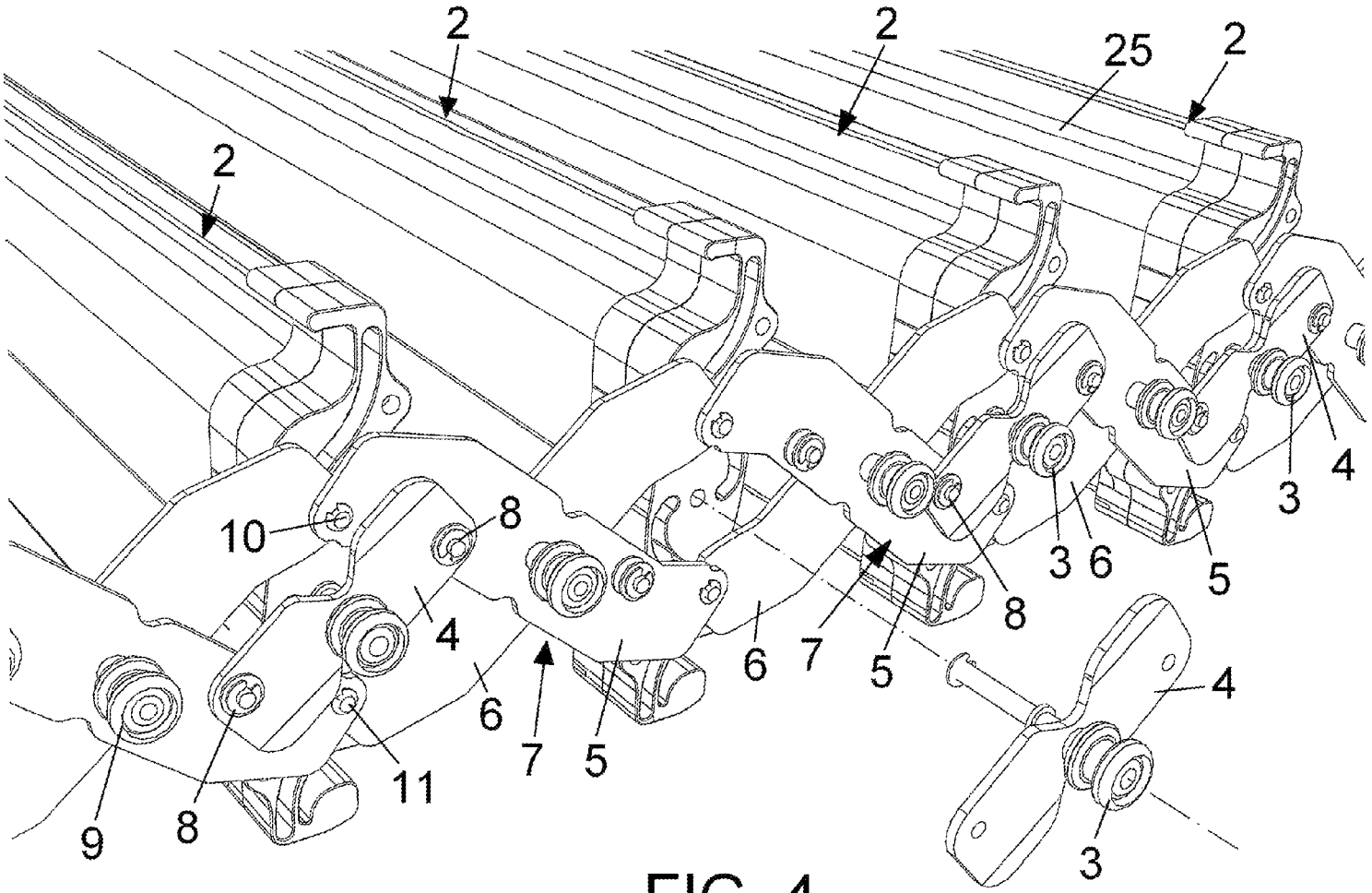
FIG. 4 is yet another perspective view, partially exploded, of the swinging blades and the link system included in the swinging blade structure according to the present invention.

With reference to the number references of the above mentioned figures, the swinging blade covering structure according to the present invention, which has been generally indicated by the reference number 1, comprises a plurality of swinging blades 2, each of which can turn about a longitudinal axis, on end pivot pins 3.

Each said pivot pin 3 is associated with a rod 4, having rod end portions pivoted to S-shape lever elements, being indicated by the reference numbers 5 and 6, respectively.

Said lever elements 5 and 6 provide a plurality of articulated systems, of a "X" shape, being so coupled to one another as to form an extensible X coupling link chain.

Each said X-shape coupling link, constituted by a lever element 5 and a lever element 6, is herein indicated by the reference number 7.

Each said swinging blade 2 is coupled to the X-shape links 7 through a coupling rod 4, operating as a coupling or connecting element, having respective end portions thereof pivoted to the lever elements 5 and 6 at middle pivot points 8.

The specifically designed "S" shape of the lever elements 5 and 6 has been chosen to prevent said lever elements from interfering with one another, during the extending or withdrawing movement of the overall articulated system.

Thus, this constructional feature allows to provide a crossed coupling link system, without using washer elements or other spacer elements, thereby providing a small size and clearance coupling chain.

Accordingly, the overall system will have a smooth and accurate response to driving commands applied thereto.

Figure 5:
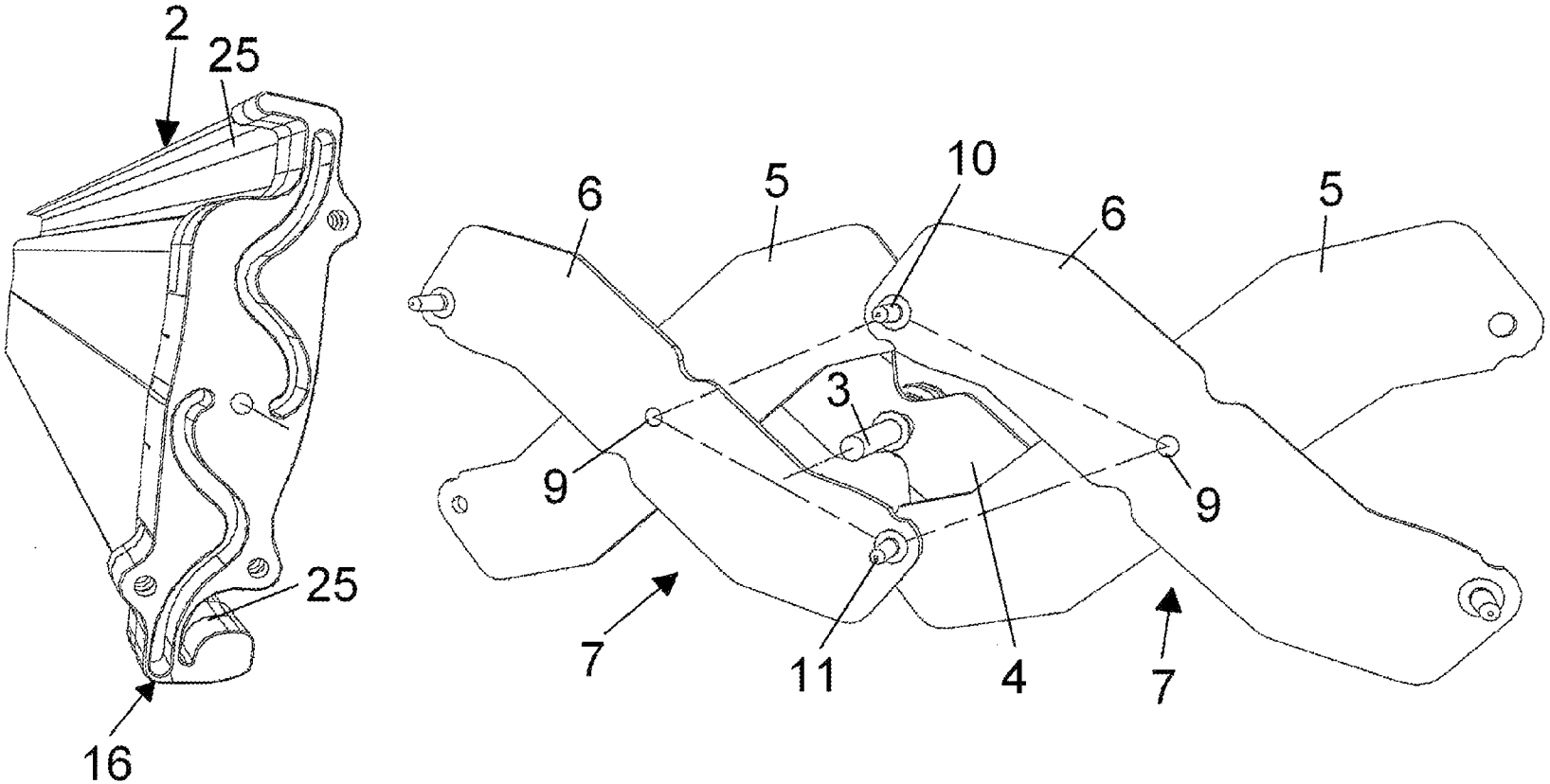
FIG. 5 is a partially exploded side elevation view showing a swinging blade and a coupling link therefor.

Each said swinging blade 2 can turn about its axis, driven by the closing or opening movement of the parallel arrangement having the apex points thereof on the articulated members consisting of the pivot centers or nodes 9 of the articulated systems 7 and pivot points 10 and 11 of the end portions of the lever elements 5 and 6, as is schematically shown in FIG. 5.

Thus, a closing or opening movement of the coupling chain, as it will be more apparent hereinafter, will cause the swinging blade 2 to automatically swing or turn, as is shown in FIGS. 4, 5, 6-8.

A tie-rod belt element 12, or other like coupling system, as it is driven, will entrain therewith a small block 13 being coupled to the first X-shape half-link, that is a head link indicated by the reference number 71, at a pivot pin 14.

Figure 10:
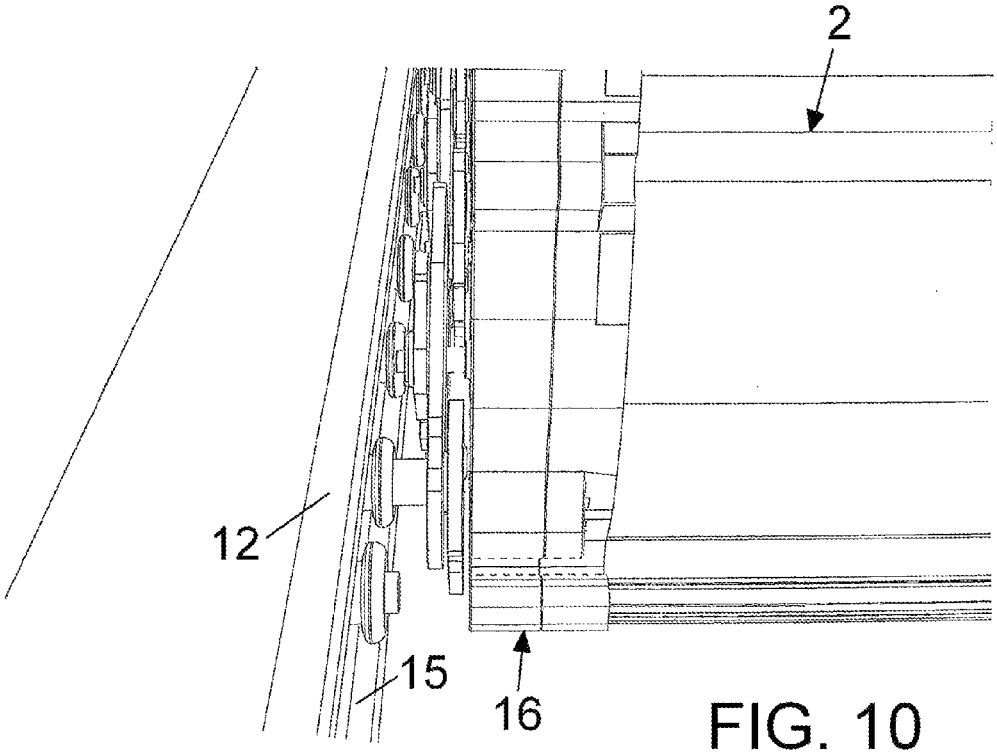
FIG. 10 is yet another front view of the swinging blade driving system.
Figure 11:
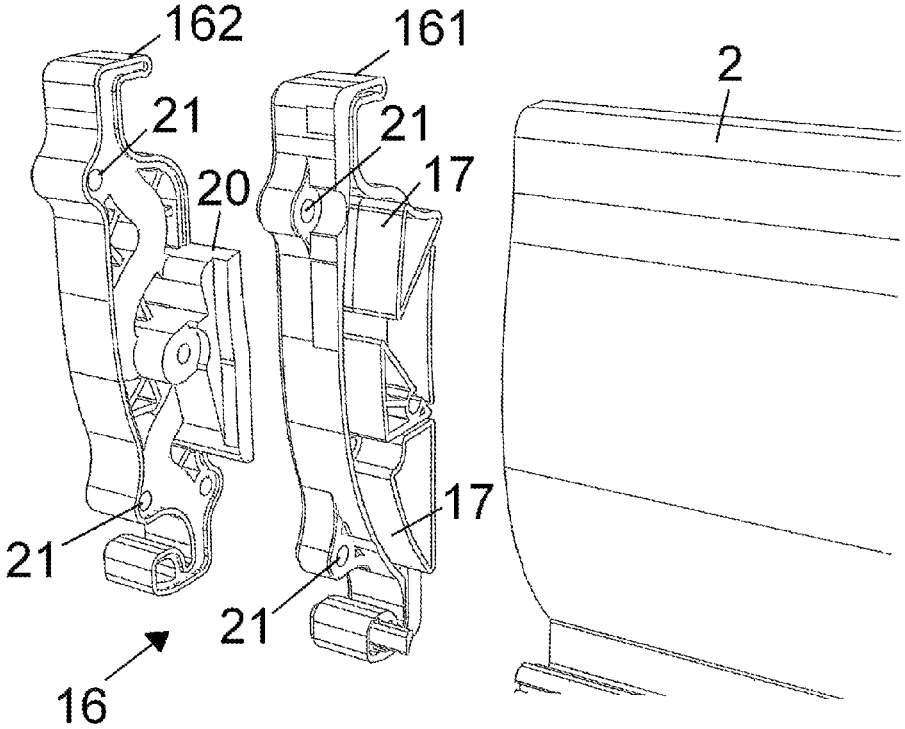
FIG. 11 is an exploded perspective view of an end portion of a swinging blade and a plug element therefor.
Figure 12:
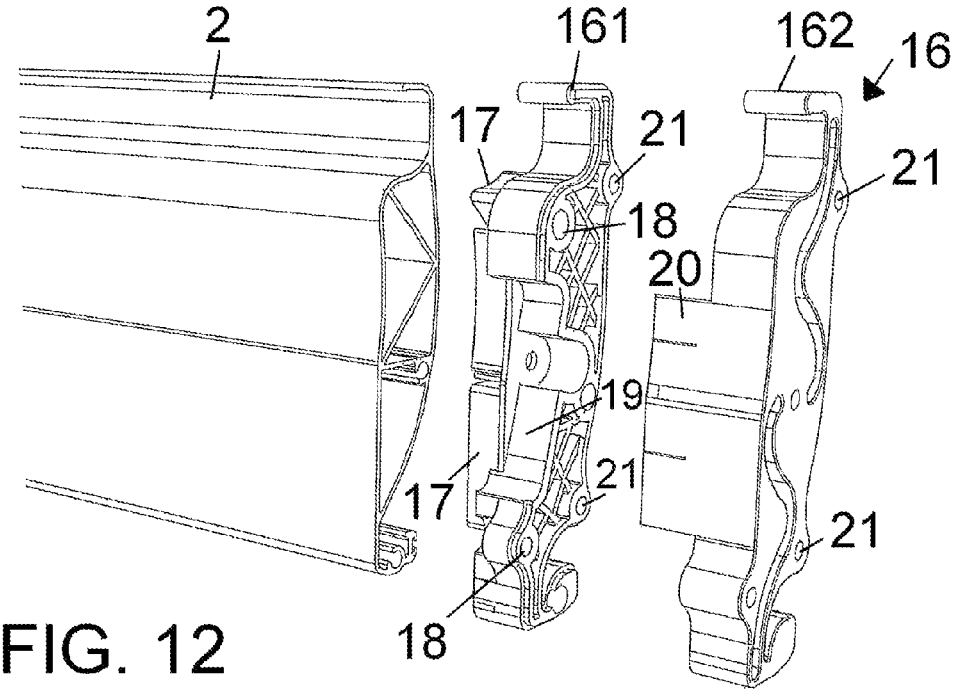
FIG. 12 is a further exploded perspective view of an opposite side of a swinging blade end portion and related plug element of FIG. 11.

During the opening movement of the swinging blades 2, the block 13 will be driven along the movement axis of the belt 12, i.e. upstream, and being advantageously guided by a guide rail 15, as is shown in FIG. 10.

Figure 9:
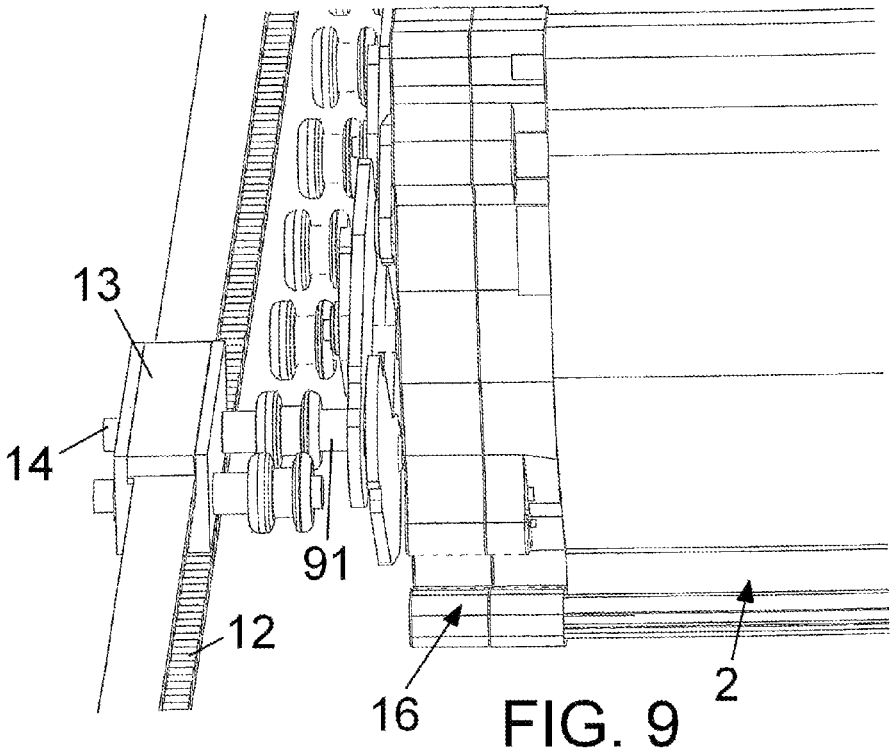
FIG. 9 is a front view of a swinging blade driving system.

In a system including a number n of swinging blades 2, in which the first node 91, being shown in FIG. 9, is coupled through the block 13 to the tie-rod or pulling belt 12, the other nodes 9 and related pivot pins, of the other X-shape coupling links 7, will be in an unbound condition, thereby being independent from said belt 12.

For providing a general alignment of the system, during the structure opening and closing operation, the pins coupled to the nodes 9 and the further pins 3 passing through the rotary sleeves of the swinging blades 2 comprise, in addition to the above disclosed mutually coupled link system, further grooved wheel elements designed for sliding in the same guide rail 15.

As shown, all the above disclosed swinging blades 2 comprise, at respective end portions thereof, plug elements 16, each said plug element 16 comprising two plug element parts, that is an inner plug element part 161 and an outer plug element part 162.

The inner plug element part 161, to be connected to the swinging blade 2, is characterized by plug members 17 adapted to perfectly engage with the swinging blade and being herein locked by clamping locking screws through corresponding holes 18.

Moreover, the inner part 161, on a side opposite to the swinging blade engaging plug members, comprises a specifically designed saddle support element 19, which, as the cover structure is assembled, is perfectly fixedly engaged in the outer part 162.

To provide a perfect coupling with the inner part, the outer part 162 further comprises a bearing element 20, adapted to be threaded under the saddle portion 19 of the inner part 161.

Thus, after having plugged-in the two parts 161 and 162, they will be finally locked by locking or clamping screws and nuts engaged in corresponding engaging recesses or seats 21.

Thus, the plug member 16, having the above disclosed features, allows the swinging blades 2 to be easily coupled and clamped to their driving system.

For assembling purposes, an operator may use the above disclosed parts, side guides, swinging blades, supporting structure and driving mechanisms therefor, already mounted on corresponding fittings, which parts would be difficult to be assembled on-site.

Figure 13:
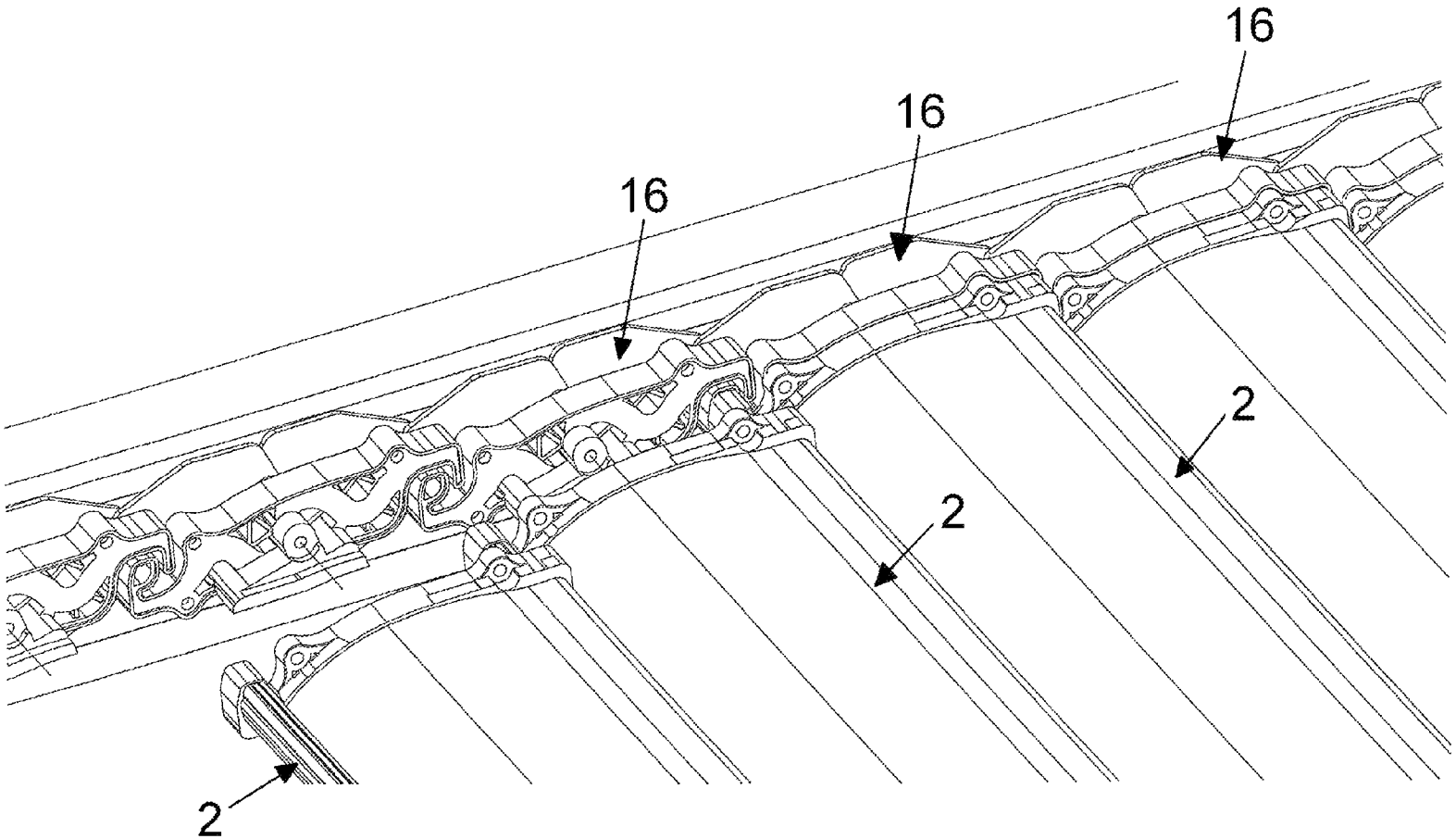
FIG. 13 is yet another perspective view showing the overall preassembled inventive system.
Figure 14:
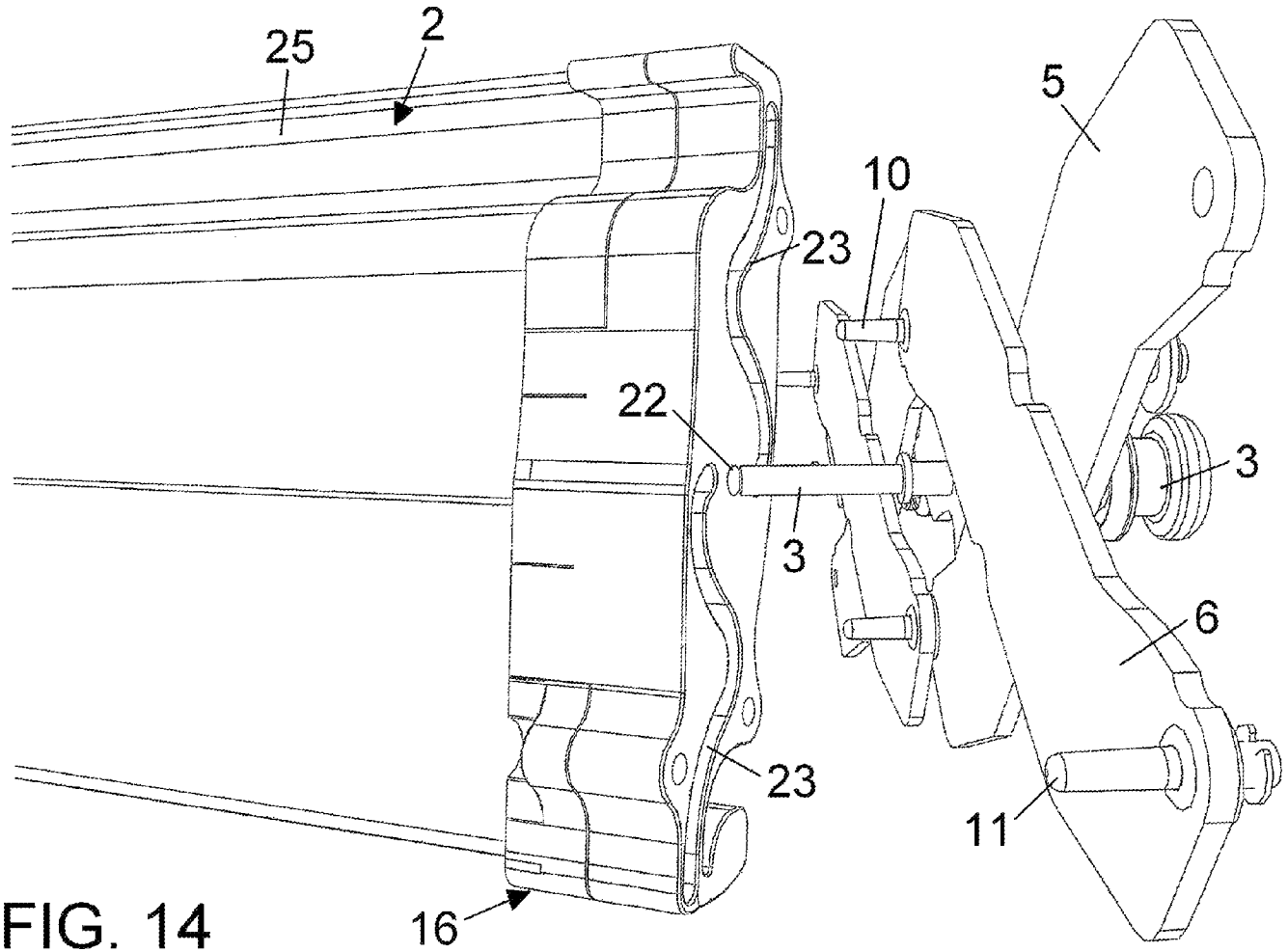
FIG. 14 is another partially exploded perspective view of an end portion of a swinging blade and coupling link system therefor.
Figure 15:
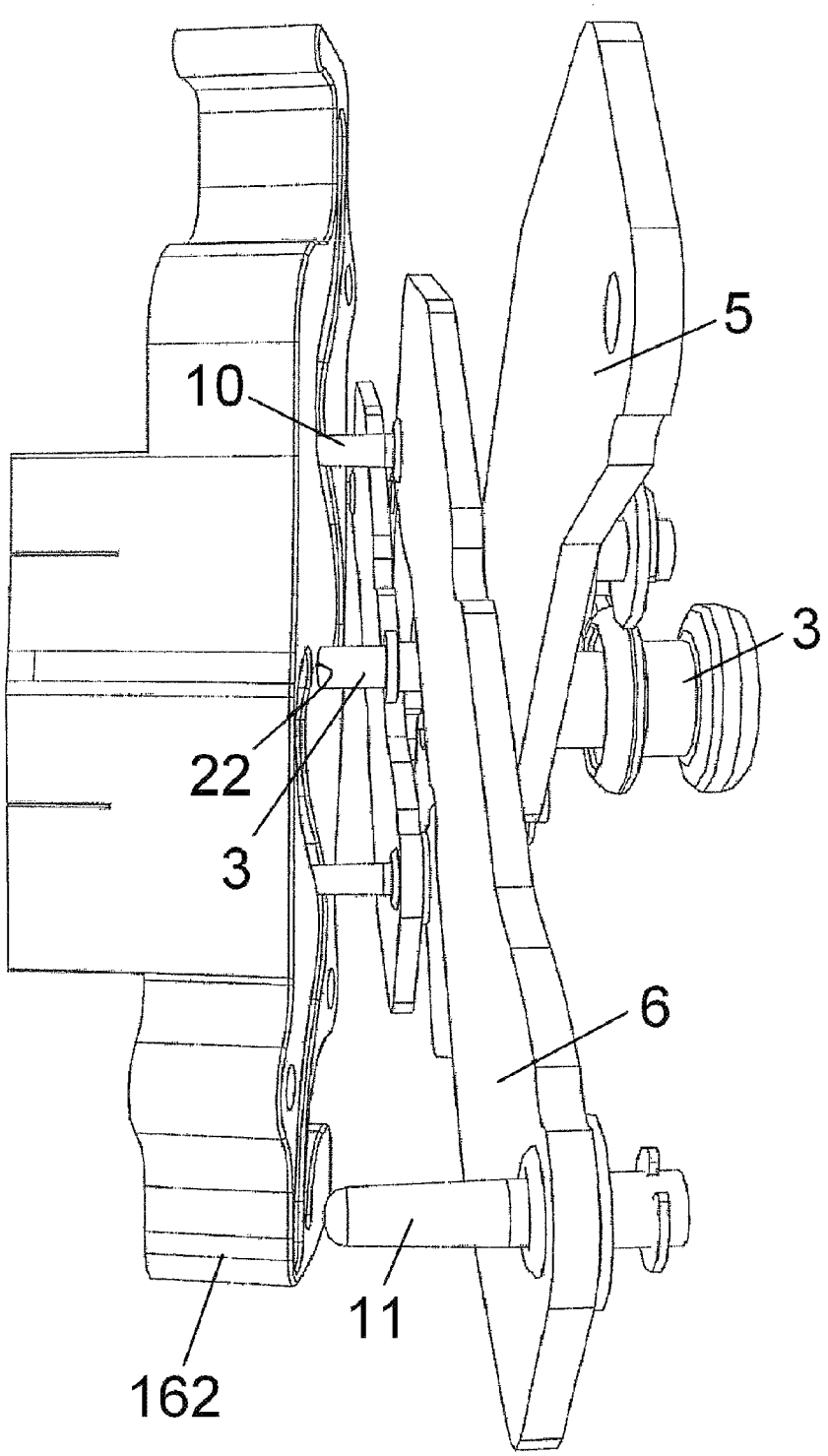
FIG. 15 is yet another partially exploded perspective view of an end portion of a swinging blade and coupling link system.

FIG. 13 shows the pre-assembled system, including a guide, a rail, a toothed belt, a coupling link chain and outer parts 162 of the plug members 16, already engaged in corresponding pins, as shown in FIG. 14, and clamped thereto, as shown in FIG. 13.

In the thus preassembled system, the swinging blades 2, including the inner parts 161 of the plug members 16, are then further assembled.

The composite plug member 16 has a plug face or surface for connection to the X-shape coupling links 7 of the system.

The plug member 16 comprises, on a face thereof, a hole 22 for receiving a pin 3 operating as a rotary sleeve for the swinging blade 2, and two guide grooves 23, arranged with a mirror-like opposite arrangement, for the pins 10 and 11.

More specifically, the grooves 23 have a specifically designed sinuous arrangement, allowing the grooves 23 to receive, in a preassembling operation, the ogival head portions of the pins 10 and 11.

Said pins 10 and 11, as they are driven, will operate on the swinging blades so as to drive the latter with a precise movement.

Depending on the cases, the outer cross-section of the plug member 16 will have, for aesthetic and functional reasons, a pattern analogous to that of the swinging blade cross-section being used.

Thus, the movement paths forcibly provided by the guide grooves 23 of the plug members 16 will cause the swinging blade 2 to perform a rotary movement about its axis, said rotary movement including four rotary movement phases, which have been shown in FIGS. 16, 17, 18 and 19, respectively, and providing four positions to be achieved by the pins 10 and 11 along their displacement in the guide grooves 23.

Figure 6:
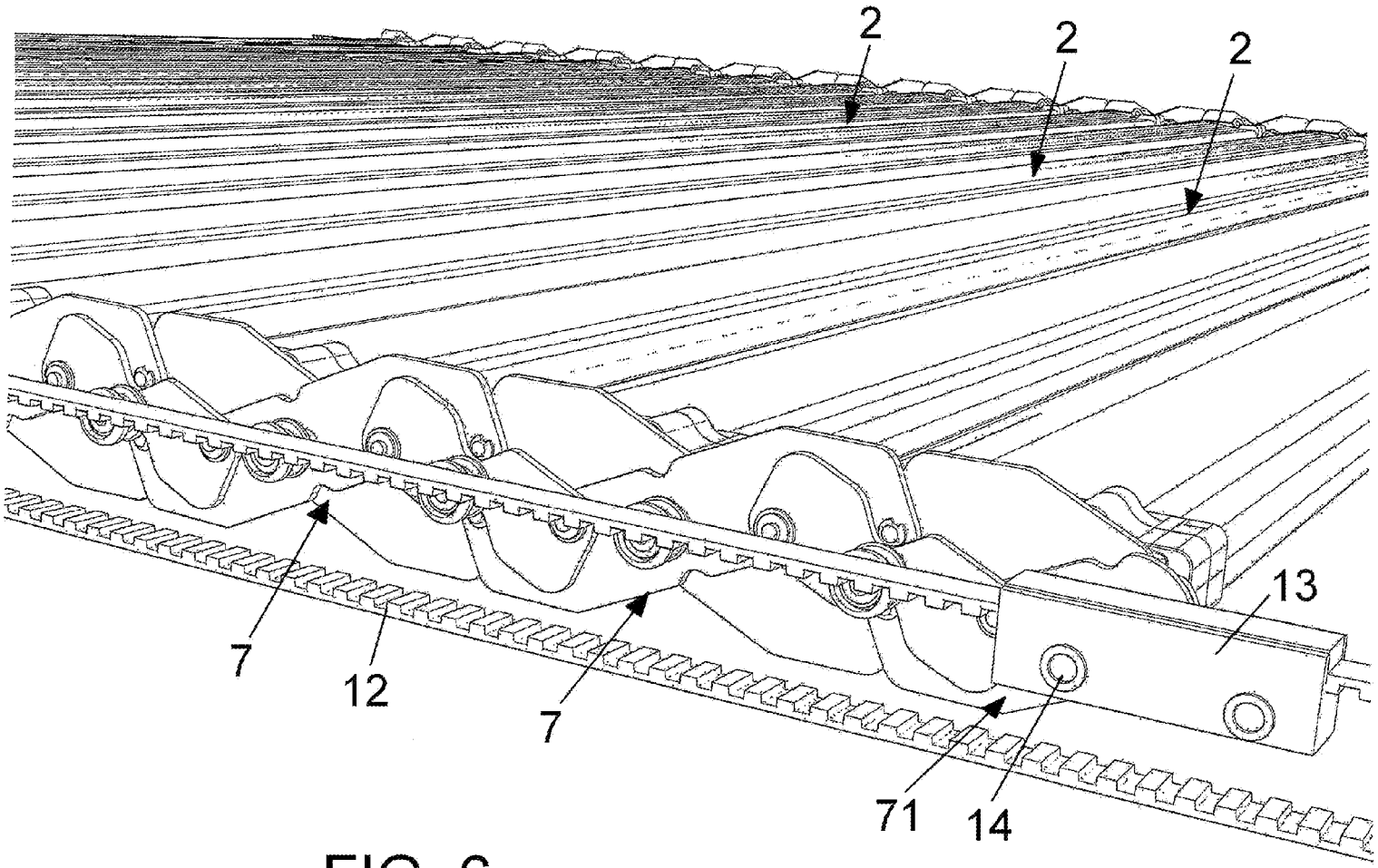
FIG. 6 is another perspective view of the inventive structure, the swinging blades being shown in a closed position thereof.
Figure 16:
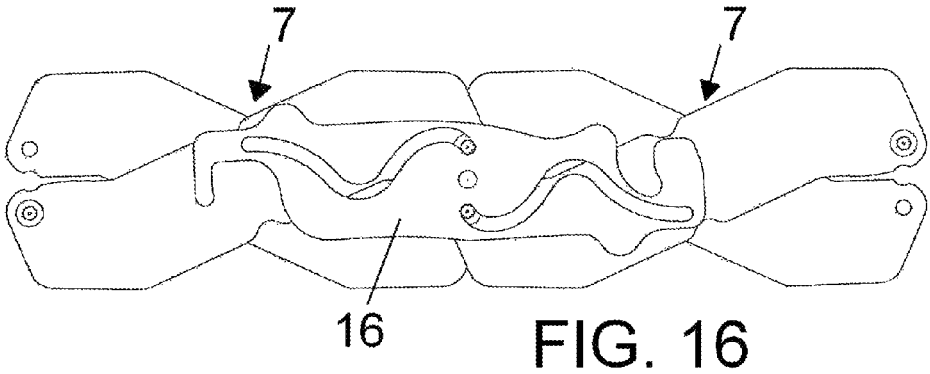
FIG. 16 is a side view of a X-shape coupling link, being shown at a position thereof corresponding to a swinging blade closed position.

More specifically, in the covering structure closed position, shown in FIGS. 6 and 16, the swinging blades 2 are in a horizontal position and the pins 10 and 11, engaged in said grooves 23, will be arranged at a starting position, shown in FIG. 16.

Figure 17:
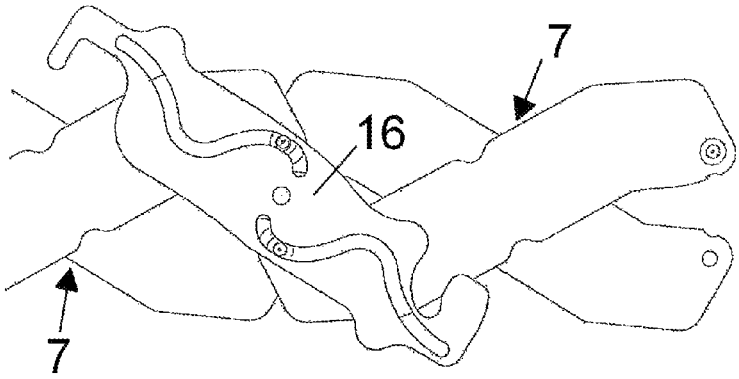
FIG. 17 is a side view of a X-shape coupling link, being shown at a position thereof corresponding to a starting swinging blade opening movement.

As the pulling system 12 is upward driven, so as to press the coupling link 7 chain, all the pins 10 and 11 coupled to the system will be driven along driving lines perpendicular to the covering plane, but in opposite directions and, by moving in the guide grooves 23, will arrive at their second position, shown in FIG. 17.

This displacement of the pins 10 and 11 in the guide groove will consequently fit the overall system plug 16 and swinging blade 2, thereby causing said system to turn about the pivot pin 3 through about 30°with respect to the "closed" position.

Figure 7:
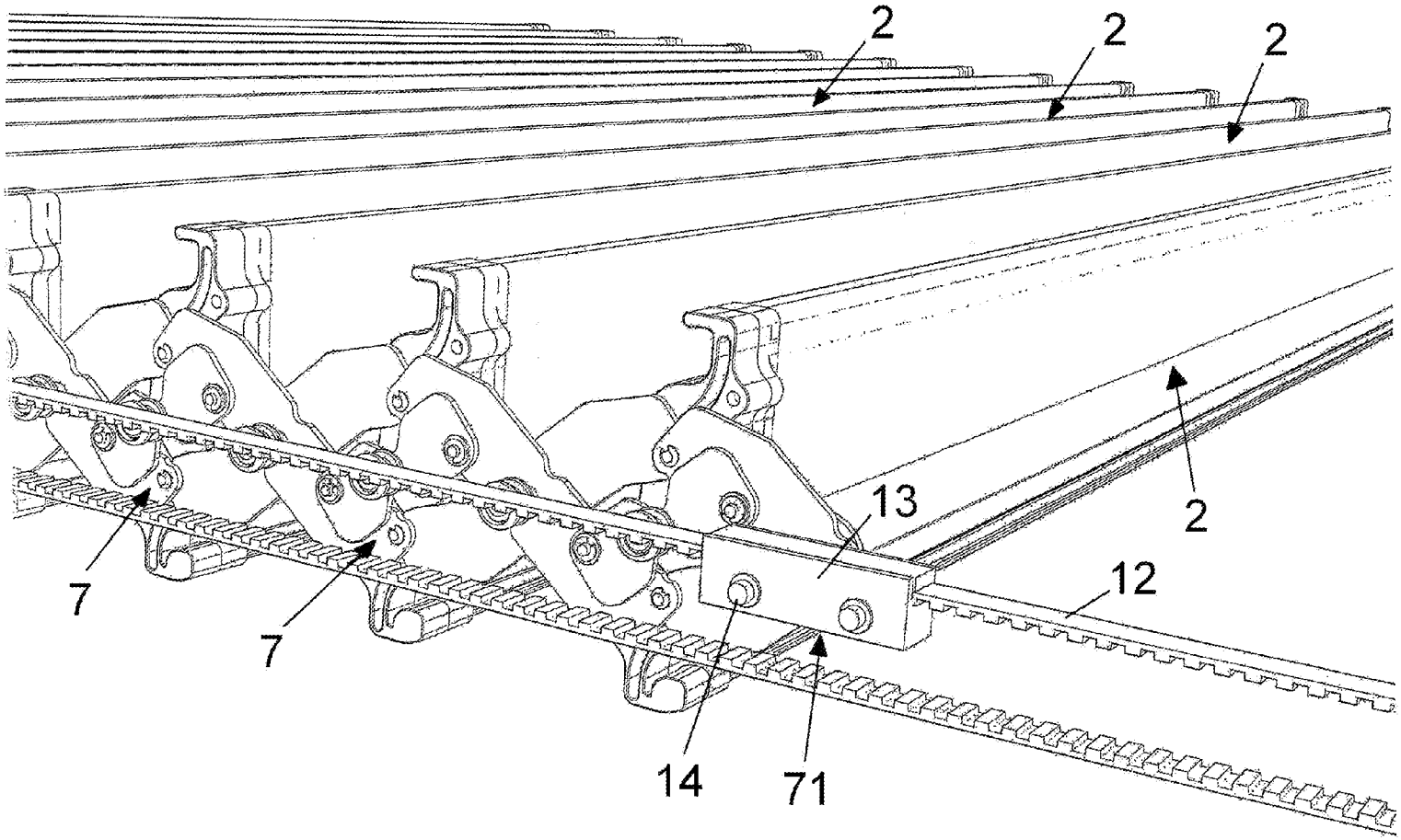
FIG. 7 is yet another perspective view, similar to FIG. 6, but showing the structure with the swinging blades in an open condition, at a position reversed or turned through 90°.
Figure 18:
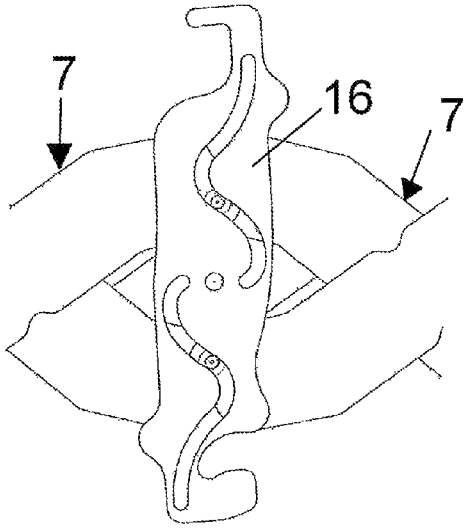
FIG. 18 is a further side view of a X-shape coupling link, being shown at a position thereof corresponding to an open position of the swinging blades.

Thus, the inclination degree of the swinging blades 2 with respect to the horizontal line will be correspondingly increased as the tie-rod 12 is upstream driven, since the pins 10 and 11, being displaced in their guide grooves 23, will push their respective swinging blades 2 to turn through 90°, up to achieve a normal horizontal position, being shown in FIGS. 7 and 18.

In this connection it should be pointed out that the swinging blades will turn through 90°, as shown in FIG. 18, and will be vertically arranged with a minimum closing movement of the chain, so as to be held at their position from the extended covering system, as shown in FIG. 6, thereby properly controlling the solar radiation of the shaded portion.

This is a main feature of the present system, since no prior art arrangement is adapted to operate in such a manner.

It is moreover pointed out that a following displacement, and accordingly a compacting of the swinging blades, will occur by continuing the same operation for pressing the disclosed link chain.

To facilitate the operation of the pulling system, the guide grooves 23 are so designed that they in no condition provide a tangent edge with an angle larger than 30° to the pins 10 and 11, with respect to their movement path.

Moreover, the swinging blade weight does not affect the swinging blade rotary movement, since they are caused to turn about their axis, in a substantially balanced condition.

After passing the 90° position, as shown in FIG. 18, all the pins 10 and 11, respectively mounted on the top and bottom articulated joints of the coupling link 7 system, and engaged in their respective guide grooves 23, related to all the swinging blades 2, can continue their centrifugal movement, allowing all said swinging blades 2 to preserve their achieved nearly vertical arrangement, which is shown in FIG. 7.

Figure 8:
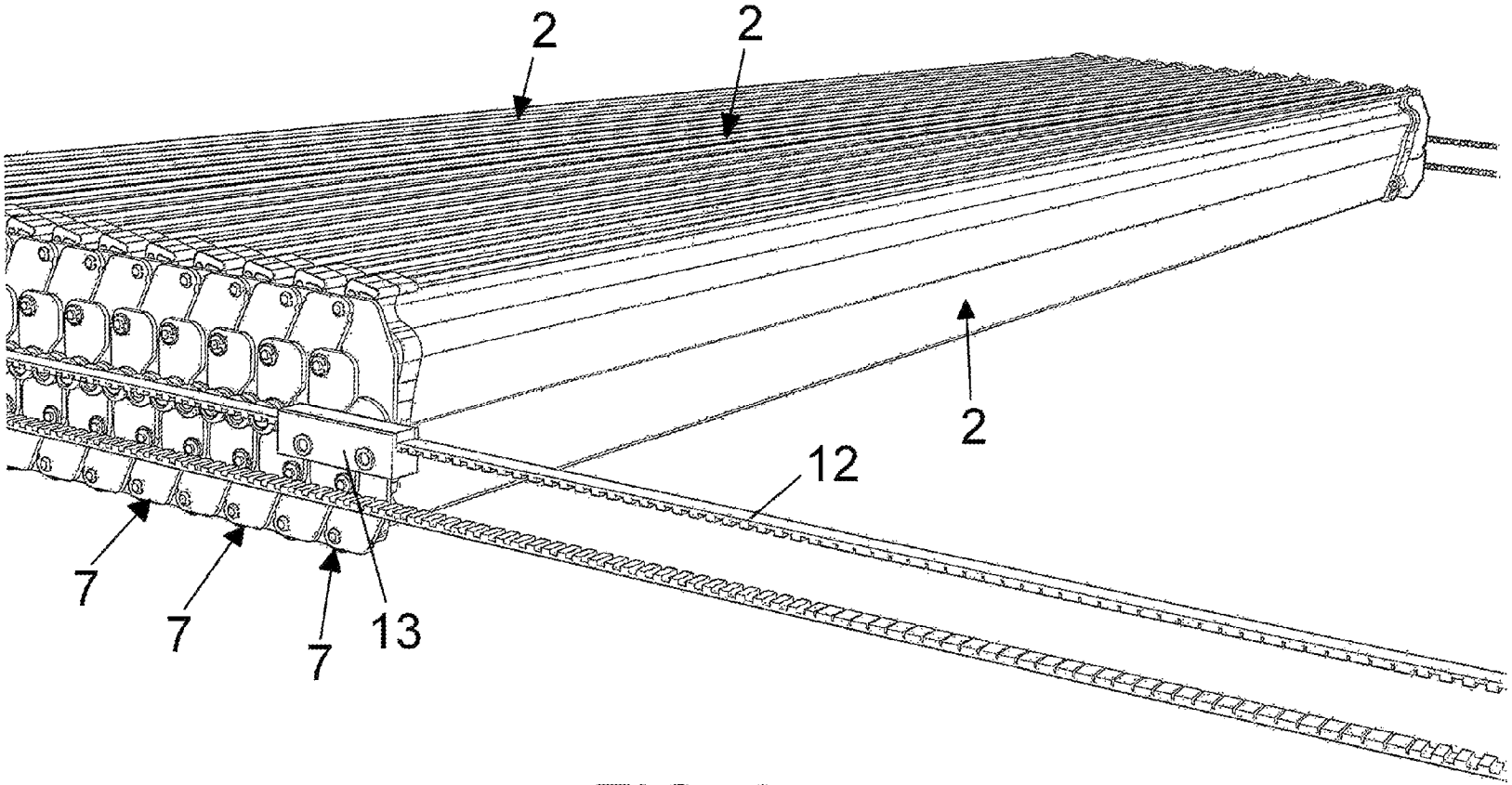
FIG. 8 is yet another perspective view of the inventive structure in an open condition, the swinging blades being shown in a compacted position.
Figure 19:
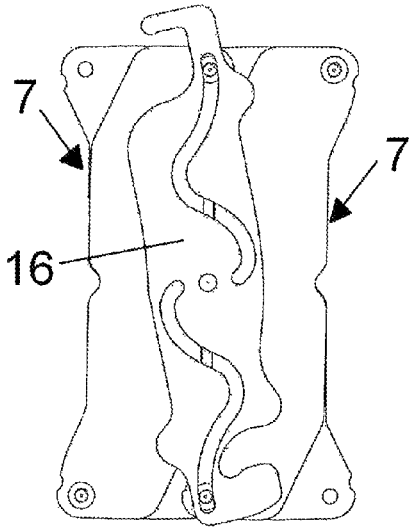
FIG. 19 is yet another side view of a X-shape coupling link, being shown at a position thereof corresponding to an open and compacted swinging blade position.

This movement, provided by the closing movement of the coupling link system, will lead all the pins 10 and 11 to their end movement condition, shown in FIG. 19, while simultaneously pushing all the swinging blades 2 to their vertical position, upstream of the overall covering system, to cause said swinging blades to be arranged adjoining one another on the top side of the covering structure, while leaving uncovered a main portion of the previously protected area, as shown in FIG. 8.

Figure 20:
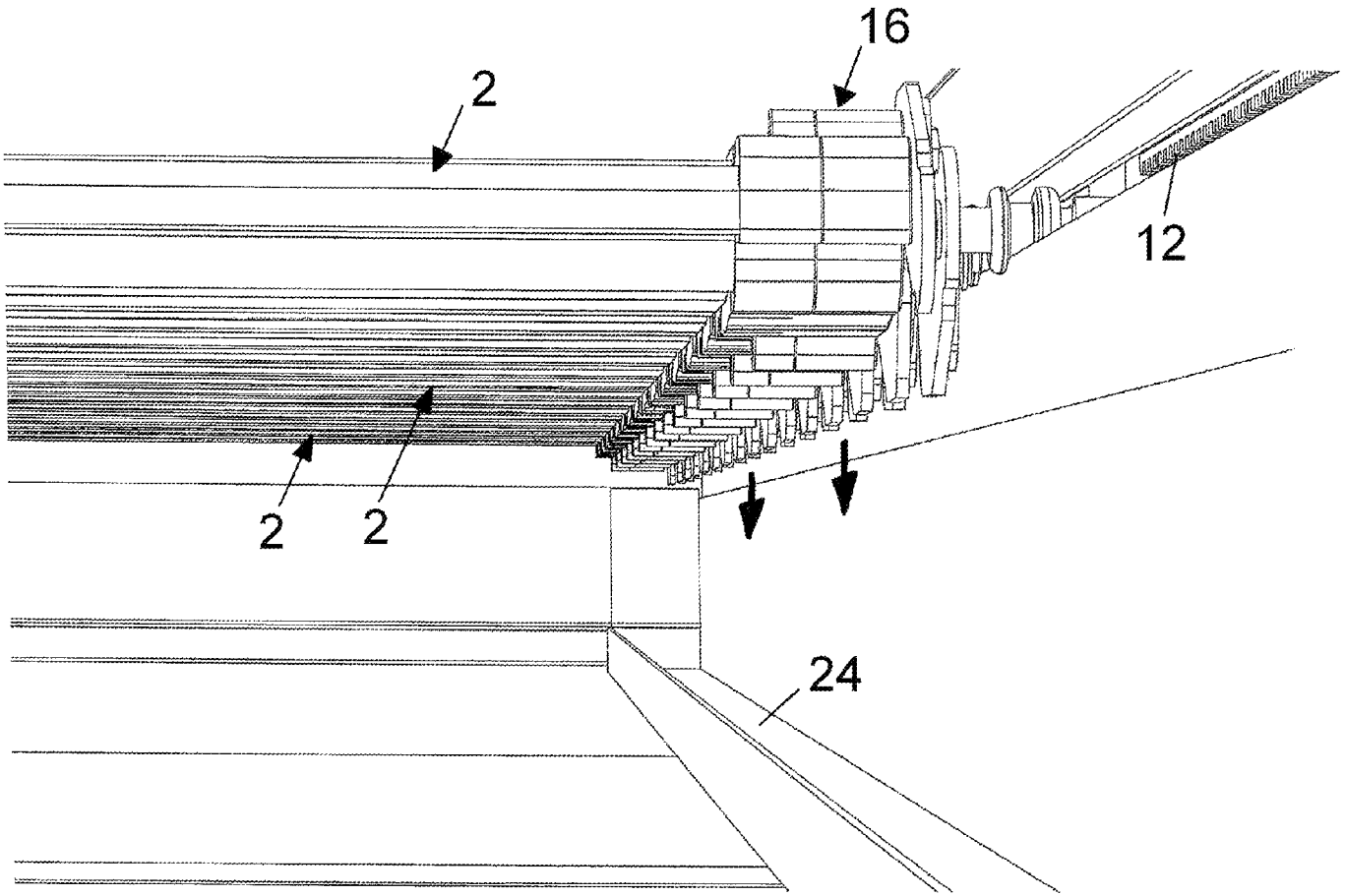
FIG. 20 is a side perspective view of the swinging blade structure according to the present invention, and showing a side gutter arrangement therefor.

When the swinging blades 2 are arranged in a fully horizontal position, as shown in FIGS. 6 and 20, the covering structure will assume a continuous aspect, thereby operating as a protecting shed or roof, also adapted to provide protection against rain.

In fact, each said swinging blade 2, adjoining with and overlapped on a following swinging blade, comprises a dedicated gutter channel 25, for draining rainwater collected in dedicated side gutter elements 24.

When, as it occurs in nearly all the cases, the covering structure plane is an inclined one, the weight of the movable system comprising the swinging blades 2 and associated connected links 7, will operate against the pulling force of the driving belt 12, starting from a closed position, up to the last movement step, while causing the overall covering structure to be closed as the driving belt 12 is released.

Thus, the overall adjoining swinging blade covering structure or system can be driven by hand, through a driving winch or by an electric motor, coupled to a driven roller receiving a driving cable or belt, as in the above disclosed case.

While the tie-rod or pulling element has been herein disclosed as a pulling belt 12, it can also consist of either a smooth or toothed belt, either of an open segment or a continuous loop type, or a cable or a worm screw, or, if desired, a linear magnetic motor or other like driving systems.

It has been practically found that the invention fully achieves the intended aim and objects.

In fact, the invention has a provided a covering structure comprising a plurality of adjoining and overlapping swinging blades coupled by a driving mechanism allowing, by a single operation, at first said swinging blades to gradually turn about their longitudinal axis, while being held in a same position, for providing a partial protection against sun, and then to cause said blades to slide on a horizontal plane, thereby compacting all said blades on a side, for uncovering the previously covered area.

In practicing the invention, the used materials, as well as the contingent size and shapes can be any, according to requirements.

The invention claimed is:

1. A swinging blade covering structure, comprising:

a plurality of blades, each blade having a longitudinal axis and blade end portions at opposite ends of the longitudinal axis;

an extensible link system including a plurality of X-shaped links, each of the plurality of X-shaped links comprising a pair of S-shaped lever elements pivotally connected to one another at a center nodal portion using a rod element supporting a rotary pivot pin, and each of the plurality of X-shaped links pivotally connected to one another at coupling end portions at the extremities of each of the pair of lever elements using a pivot point;

the blade end portions coupled to the extensible link system using the rod element supporting the rotary pivot point so as to arrange the plurality of blades in parallel with one another and to allow each of the plurality of blades to rotate about the longitudinal axis;

the blade end portions including a plug element comprised of an inner part and an outer part, the inner part including insert plugs secured to the blade end portions using clamping screws and including a saddle support that provides a matting fit between the inner part and the outer part, the outer part including a bearing element adapted to be treaded under the saddle support and including a plug face that engages the pivot point to control the rotation and translation of the plurality of blades;

the extendible link system providing for a transition between a closed position in which the plurality of blades are fully extended and an open position in which the plurality of blades are fully retracted, the transition between the closed position and the open position requiring a ninety degree rotation of each of the plurality of blades about the longitudinal axis and a subsequent translation of the plurality of the blades in a direction perpendicular to the longitudinal axis.

2. A swinging blade covering structure of claim 1, further comprises an actuator means comprised of a plurality of tie-rod elements for actuating the extensible link system.

3. A swinging blade covering structure of claim 2, wherein the actuator means is comprised of a block assembly coupled to a first X-shape half-link at an end position of the extensible link system; and a pulling belt coupled to the block assembly in a manner to drive the block assembly upstream.

4. A swinging blade covering structure of claim 3, further comprising a guide means for guiding the extensible link system, the guide means comprising a guide rail element for the block assembly; and grooved wheel elements attached to each of the rod elements, the grooved wheel elements sliding in the guided rail element.

5. A swinging blade covering structure of claim 1, wherein the plug face comprises a pivot pin receiving bole and two guide grooves, each guide groove being a mirror image of the other and the two guide grooves positioned longitudinally on opposite sides of the pivot pin receiving hole; and wherein each guide groove is sinuous shaped in such a manner as to provide for the plurality of blades to transition between at least four angular positions as the pivot point travels the length of each of the two guide grooves, the at least three angular positions being zero degrees offset to the longitudinal axis corresponding to a closed position, a thirty degree offset to the longitudinal axis corresponding to a partially open position and a ninety degree offset to the longitudinal axis corresponding to a fully open position.

6. A swinging blade covering structure of claim 1, further comprising a gutter channel embedded within each of the plurality of the blades.

7. A swinging blade covering structure of claim 3, further comprising a manual driving winch assembly or an electric motor coupled to a pulling belt.

* * * * *